US010065713B2

(12) United States Patent
Murphy

(10) Patent No.: US 10,065,713 B2
(45) Date of Patent: Sep. 4, 2018

(54) ADJUSTABLE KAYAK SEAT

(71) Applicant: DICK'S SPORTING GOODS, INC., Coraopolis, PA (US)

(72) Inventor: Peter Murphy, Pattaya (TH)

(73) Assignee: DICK'S SPORTING GOODS, INC., Coraopolis, PA (US)

( * ) Notice: Subject to any disclaimer, the term of this patent is extended or adjusted under 35 U.S.C. 154(b) by 0 days.

(21) Appl. No.: 14/762,113

(22) PCT Filed: Jun. 22, 2015

(86) PCT No.: PCT/US2015/037025

§ 371 (c)(1),
(2) Date: Jul. 20, 2015

(87) PCT Pub. No.: WO2015/196211

PCT Pub. Date: Dec. 23, 2015

(65) Prior Publication Data

US 2017/0106951 A1 Apr. 20, 2017

Related U.S. Application Data

(60) Provisional application No. 62/015,146, filed on Jun. 20, 2014.

(51) Int. Cl.

| | |
|---|---|
| ***B63B 17/00*** | (2006.01) |
| ***B63B 35/71*** | (2006.01) |
| *B63B 29/04* | (2006.01) |

(52) U.S. Cl.

CPC ..... *B63B 35/71* (2013.01); *B63B 29/04* (2013.01); *B63B 2035/715* (2013.01); *B63B 2709/00* (2013.01)

(58) Field of Classification Search

CPC ..... B63B 29/04; B63B 35/71
See application file for complete search history.

(56) References Cited

U.S. PATENT DOCUMENTS

| | | | |
|---|---|---|---|
| 5,056,533 | A | 10/1991 | Solano |
| 6,112,693 | A | 9/2000 | Addison |
| 6,827,396 | B1 | 12/2004 | Jewell |
| 7,273,243 | B2 | 9/2007 | Prugarewicz |
| 7,766,427 | B2 | 8/2010 | Kojima |

(Continued)

OTHER PUBLICATIONS

ISA/US, International Search Report and Written Opinion issued on PCT application No. US15/37025, dated Sep. 17, 2015, 9 pages.

*Primary Examiner* — Stephen P Avila
(74) *Attorney, Agent, or Firm* — Pepper Hamilton LLP

(57) ABSTRACT

A watercraft seat includes a seat base movably mountable to a support surface, such as the deck of a watercraft. The mount includes a first lift link having a first end pivotally coupled to a support surface of the watercraft and a second end pivotally coupled to a front portion of the seat base and a second lift link distally located from the first lift link and having a first end pivotally coupled to a support surface of the watercraft and a second end pivotally coupled to a rear portion of the seat base. The seat base is movable between at least a first position, wherein the seat base is positioned proximate to the support surface, and a second position, wherein at least one of the front portion or the rear portion of the seat base is positioned distal from the support surface.

10 Claims, 20 Drawing Sheets

(56) References Cited

U.S. PATENT DOCUMENTS

| | | | | |
|---|---|---|---|---|
| 8,651,576 | B2 | 2/2014 | Farber | |
| 9,242,703 | B2 * | 1/2016 | Nutz ..... | B60N 2/1605 |
| 2009/0038526 | A1 | 2/2009 | Walton | |

* cited by examiner

ADJUSTABLE KAYAK SEAT

CROSS REFERENCE TO RELATED APPLICATION

This application is a non-provisional application claiming priority from U.S. Provisional Application Ser. No. 62/015,146, filed Jun. 20, 2014, and incorporated herein by reference in its entirety.

FIELD OF THE DISCLOSURE

The present description relates generally to a watercraft seat and more particularly to an adjustable seat for small personal watercraft such as a kayak, canoe, or the like.

BACKGROUND OF RELATED ART

Small watercraft, such as kayaks, canoes, etc. are generally well known. Typically, seats for kayaks generally include a substantially horizontal seat with an integral, substantially vertical back support. Other seats have a tiltable back support which can be separately inclined relative to the horizontal support. Such seats are often constructed of molded plastic and are contoured to conform to the general shape of a person's buttocks and lower back.

A conventional kayak seat is fixed to an inside bottom surface of a kayak hull so that a person's buttocks are at the same general elevation as the person's feet, which extend forward of the seat. Adjustable foot pegs are often included along the inner gunwales of the kayak to provide longitudinal support for a person's feet in the kayak. This arrangement provides stable support for a person low within the cockpit of the kayak and enables a person to use his or her legs and body to assist in controlling the kayak's attitude and movement in the water.

U.S. Pat. No. 6,112,693 describes a kayak seat with means for adjusting the height of a seat relative to the water line in a. kayak. This reference describes a rigid seat which may be elevated using blocks or a screw-type linkage beneath the seat. The screw-type linkage requires the user to turn a knob, and subsequently an endless screw, so as to move various linkages that pivot to adjust the height of the seat.

U.S. Pat. No. 8,651,576 describes a multi-position seat for a kayak having a pair of side elevation adjusters engaging the seat frame on its lateral sides. Each adjuster includes a thumbwheel adjuster within an elevator traveler within a side frame, the traveler engaging a threaded shaft that is held in a fixed rotational position. The frame includes a tunnel structure associated with a front cross member. A strap passes through the tunnel, exits at lateral sides of the front cross member, and connects to lateral sides of the pivotally connected back support. The strap is user-adjustable in length so that the angle of the back to the seat is adjustable.

US Patent Publication No. 2009/0038526 describes a removable seat for a kayak including a base configured to be sliadably engaged with a contoured shape on the base of the hull. The seat is operable to slide in forward and aft directions within the hull, and the seat and the base are removable from the hull.

There remains, however, a need for a new and improved seat for small watercraft which can be relatively quickly and/or easily adjusted between various seat heights.

DETAILED DESCRIPTION

The following description of example methods and apparatus is not intended to limit the scope of the description to the precise form or forms detailed herein. Instead the following description is intended to be illustrative so that others may follow its teachings.

In some situations, such as for example during fishing, sight-seeing, egress/ingress, etc., it is desirable to quickly and easily raise a kayak seat up off of the kayak floor while the user is within the kayak itself, or outside of the kayak to enable, among other things, a better field of vision, access to below the seat base, and/or allow for an easier height of the kayak seat base itself when transferring to or from the kayak. In still other examples, it is desirable for the kayak seat to fully pivot away from the base of the kayak to allow for still further access under the seat and/or to allow for a user to stand or sit/kneel in the cockpit of the kayak similar to a paddle board, or to otherwise have additional room within the cockpit.

Figure 1:
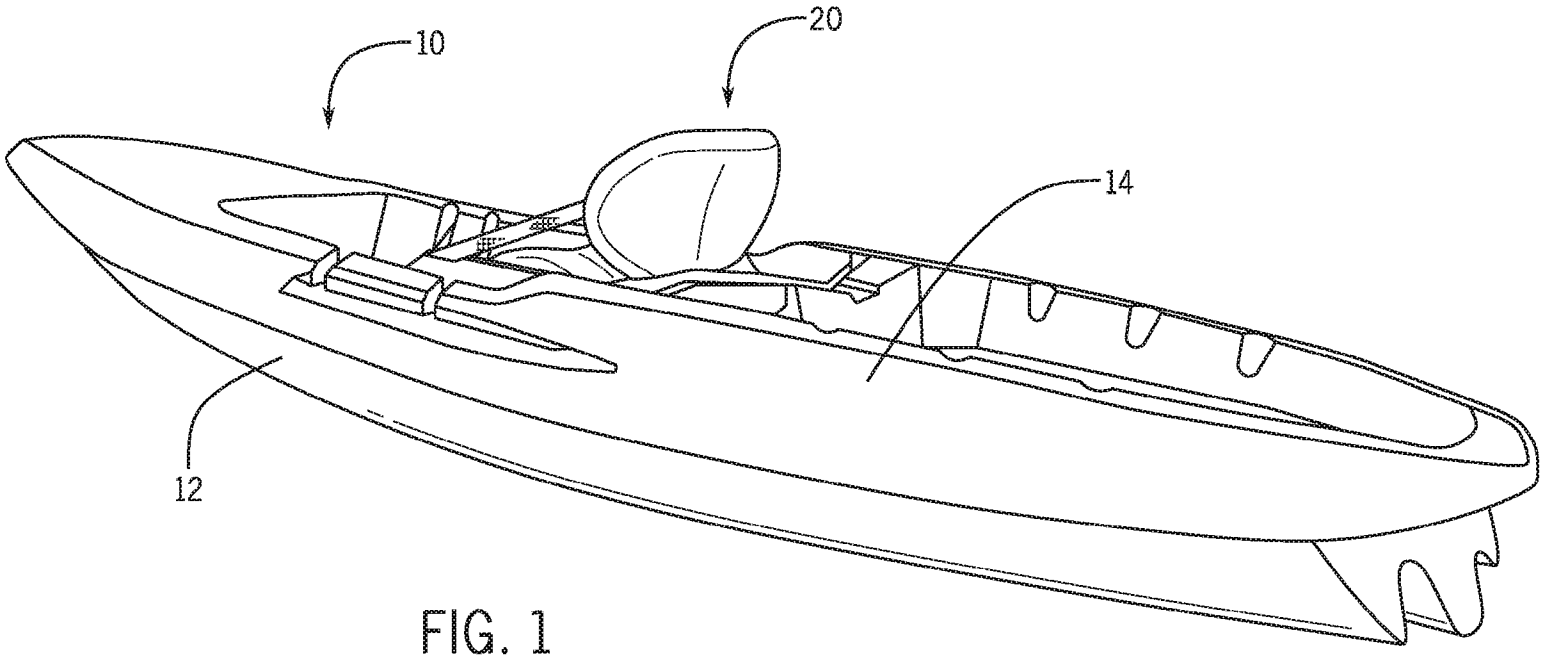
FIG. 1 is a rear perspective view of an example of the adjustable kayak seat in accordance with the present disclosure, showing the example seat in the "seat down" position.
Figure 2:
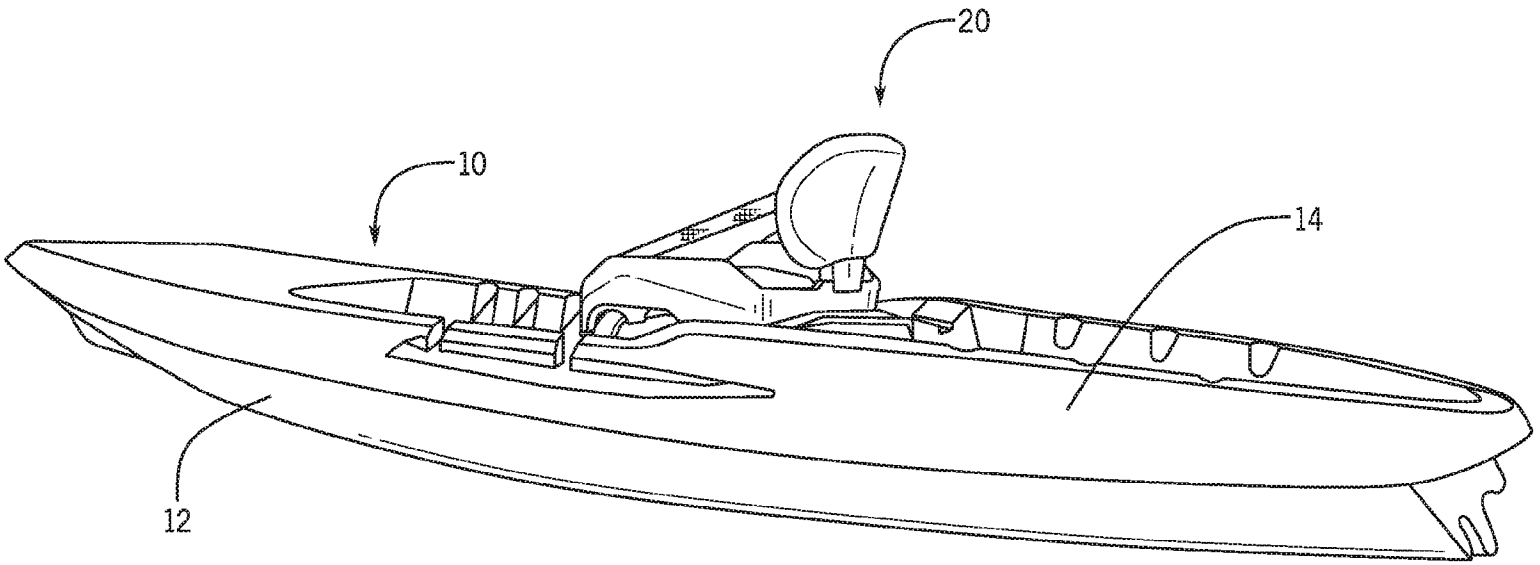
FIG. 2 is a rear perspective view of the example adjustable kayak seat of FIG. 1, showing the example seat in the "seat up" position.
Figure 3:
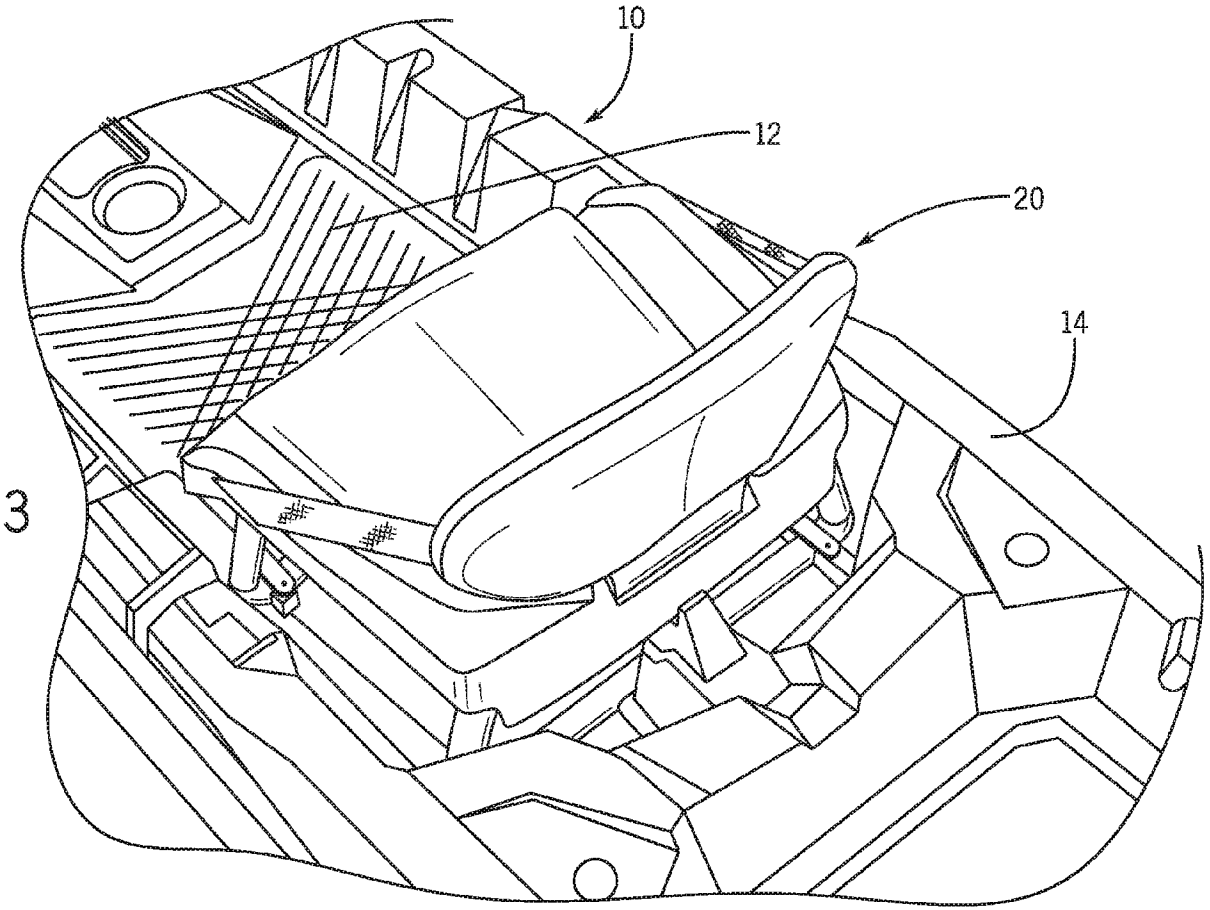
FIG. 3 is a close-up rear perspective view of the example adjustable kayak seat of FIG. 2, showing the seat in the "seat up" position.
Figure 4:
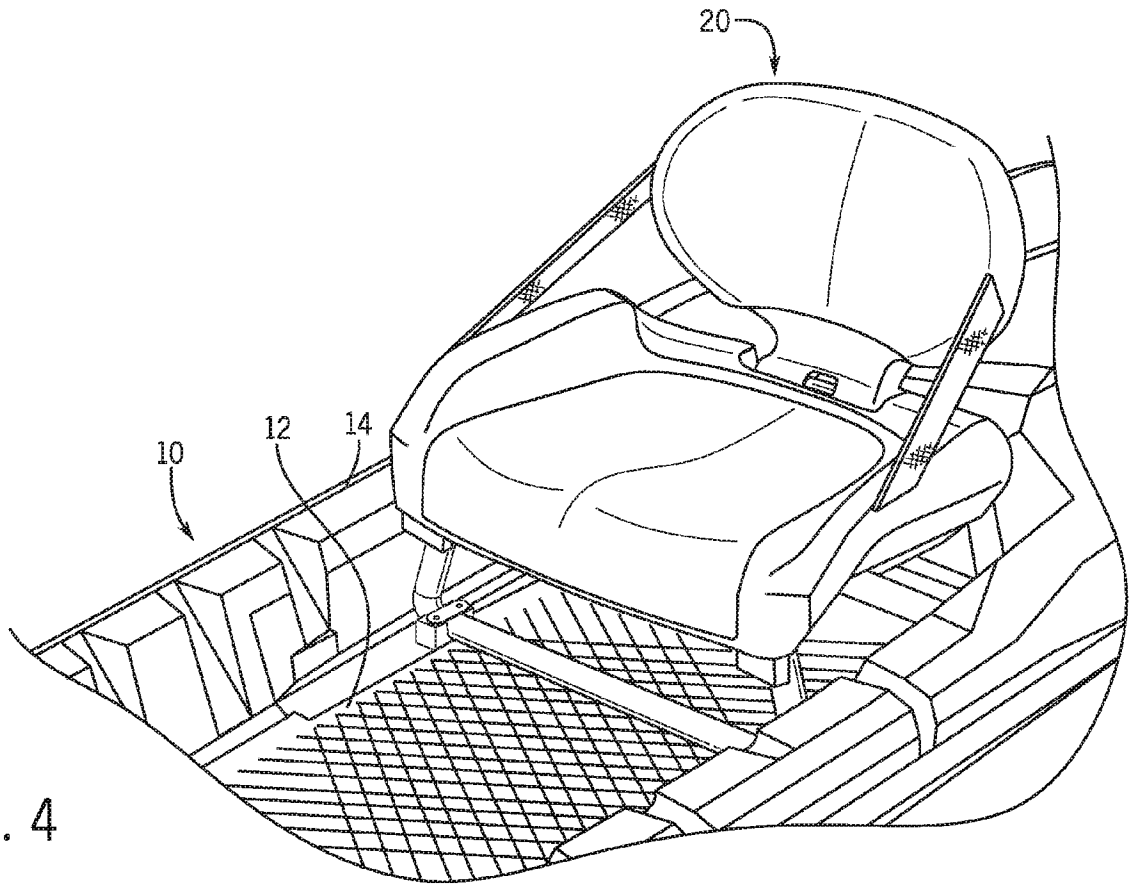
FIG. 4 is a close-up front perspective view of the example adjustable kayak seat of FIG. 2, showing the seat in the "seat up" position.

Referring now to FIGS, 1-4, an example kayak seat 20 is illustrated with an example kayak 10. In the example of FIG. I, the seat 20 is illustrated in the "seat down" position, wherein the seat 20 is deployed proximate a floor 12 of the hull 14. In the example of FIGS. 2-3, the seat 20 is illustrated in the "seat up" position, wherein the seat 20 is rotated to a height adjustable position above the floor 12 of the hull 14. In this example, the seat 20 is raised approximately four inches off of the kayak cockpit floor 12. In this position, the seat 20 may provide the user with a better field of vision as opposed to the "seat down" position of FIG. 1, wherein the user is sunk deeper within the cockpit.

Figure 5A:
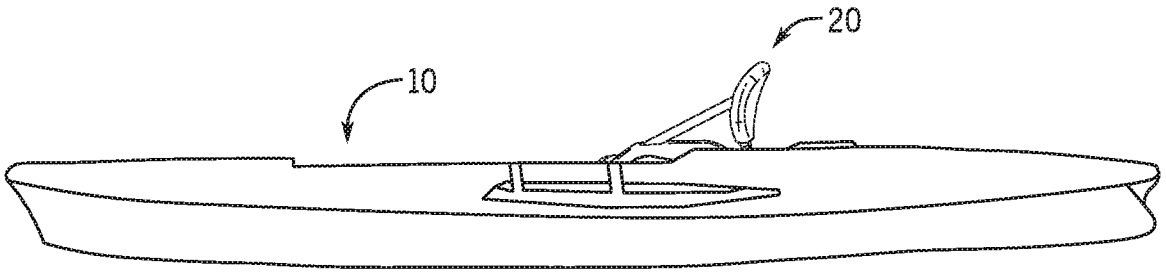
FIGS. 5A-5C each illustrated an example adjustable kayak seat in a "seat up", "seat down", and folded back position, respectively.
Figure 5B:
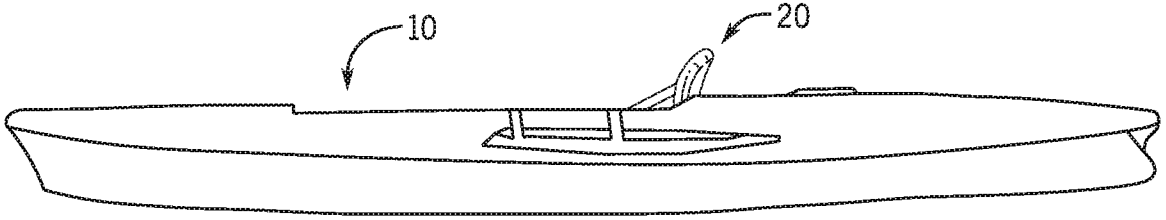
Figure 5C:
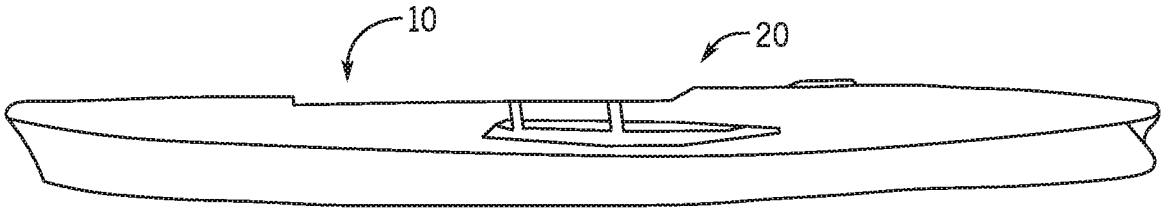

FIGS. 5A also illustrate another example of the seat 20 as it is deployed in various positions relative to the example kayak 10. In FIG. 5A, the seat 20 is deployed in the "seat up" position. In FIG. 5B, the seat 20 is deployed in the "seat down" position. In FIG. 5C, the front of the seat 20 is detached from the floor 12 of the cockpit of the kayak 10 and rotated into a "seat back" position as will be described in more detail herein below.

Figure 10:
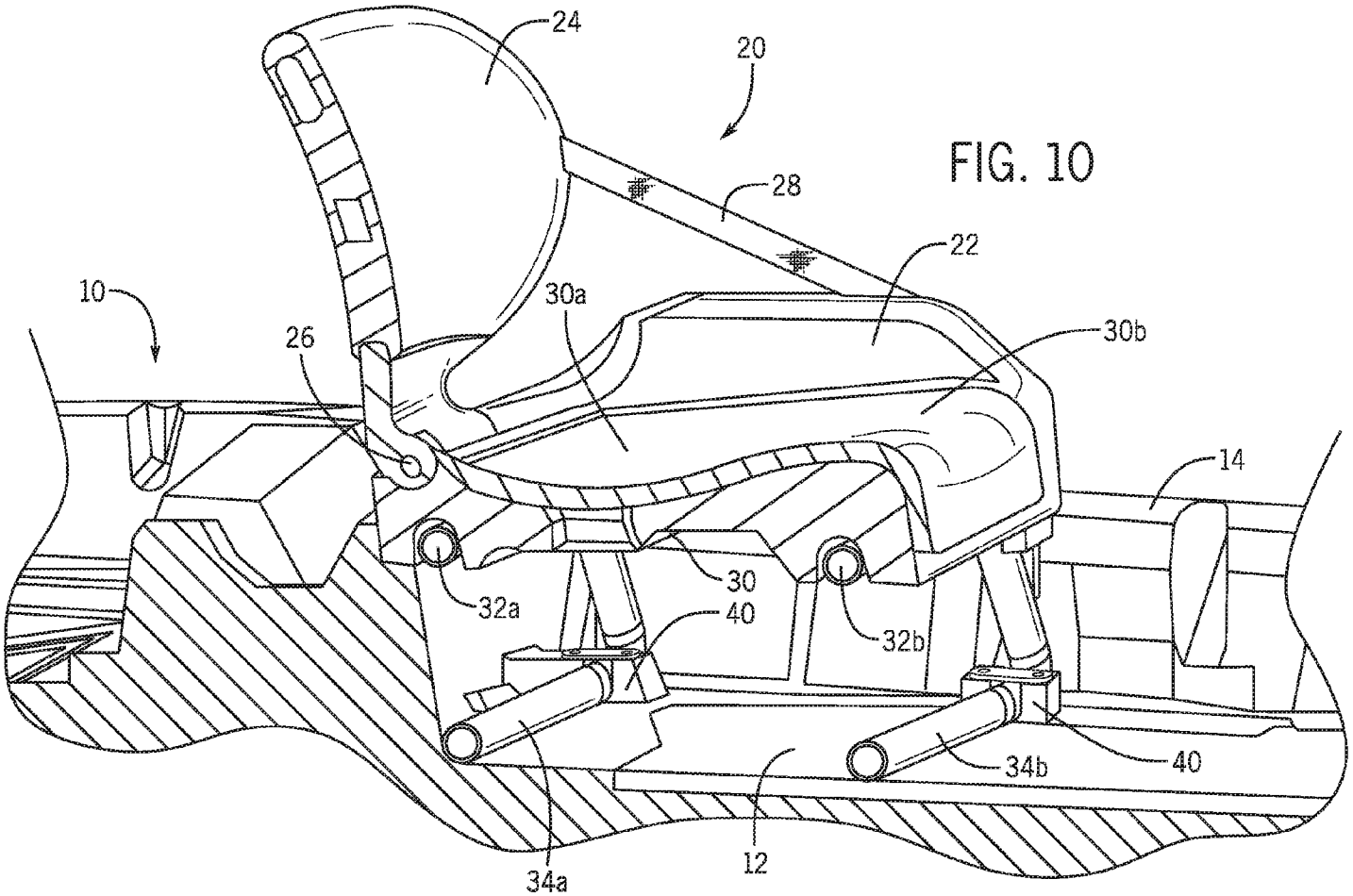
FIG. 10 is a partial cross sectional view of the example adjustable seat and kayak of FIG. 1.
Figure 11:
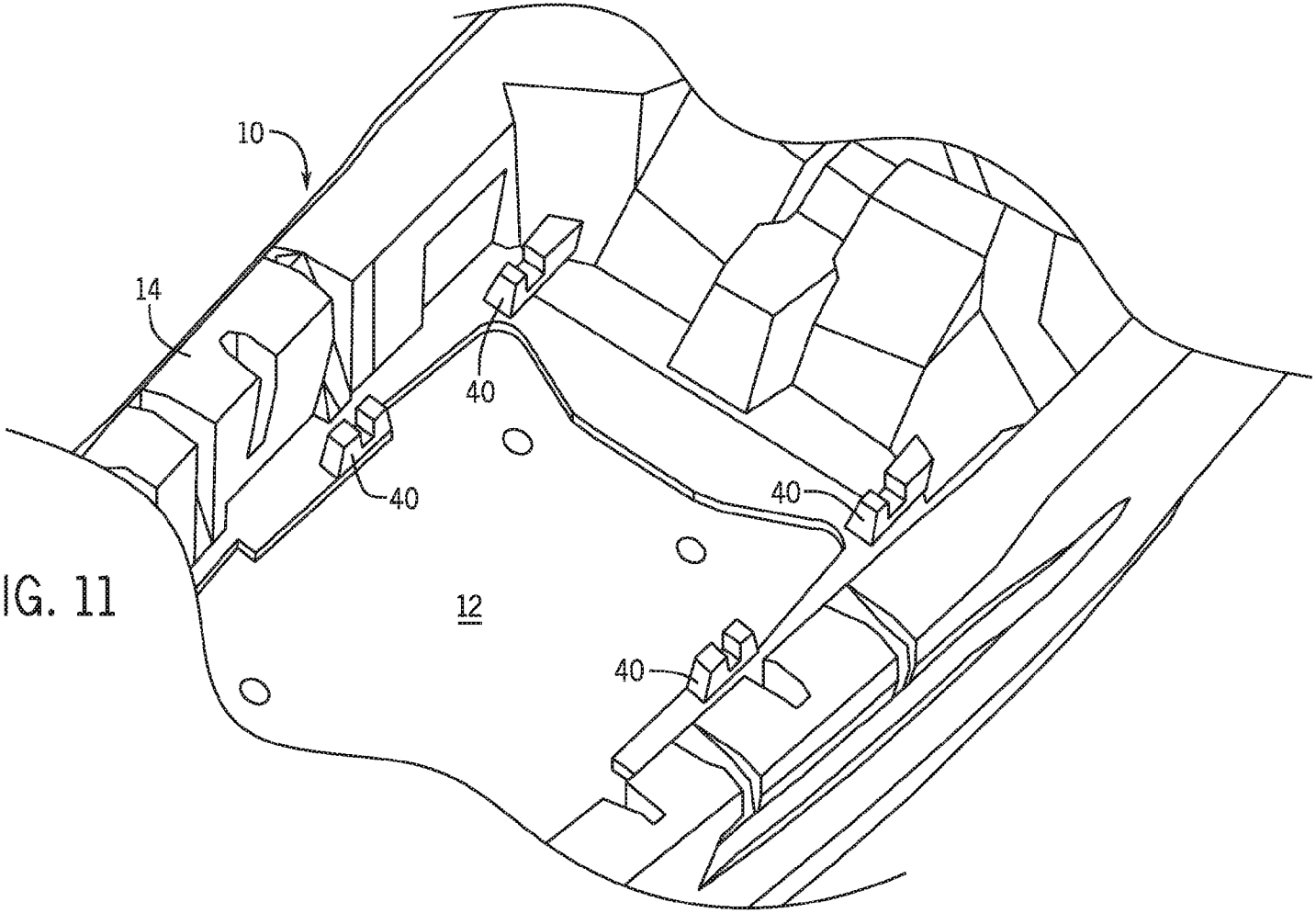
FIG. 11 is a top perspective view of the example kayak of FIG. 1 with the example seat removed.

Referring to FIG. 10, the example seat 20 generally includes a seat pan or a seat base 22, and a seat back 24. In this example, the seat back 24 is pivotally connected to the rearward portion of the seat base 22 via a pivot, such as, for example a hinge 26. A tether 28 may be provide and may extend between the seat back 24 and the seat base 22 to limit the pivotal movement of the seat back 24 relative to the seat base 22, and/or to provide additional support to the seat back 24. The tether 28 may be any suitable tethering system including, for instance, an adjustable strap.

Figure 6A:
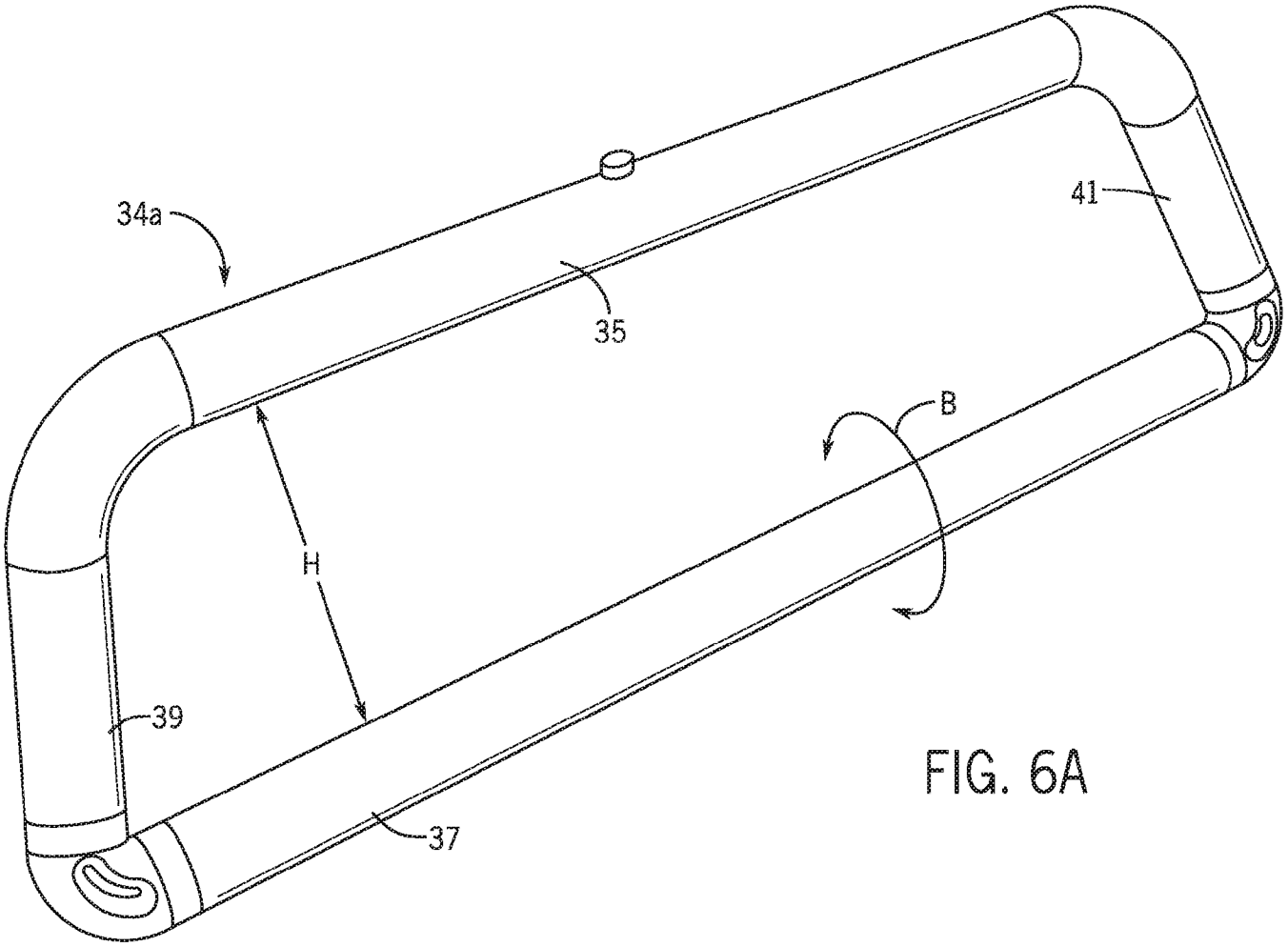
FIGS. 6A and 6B illustrate one example lift link, and lift link combination for use in adjusting the example seat of FIG. 1.
Figure 6B:
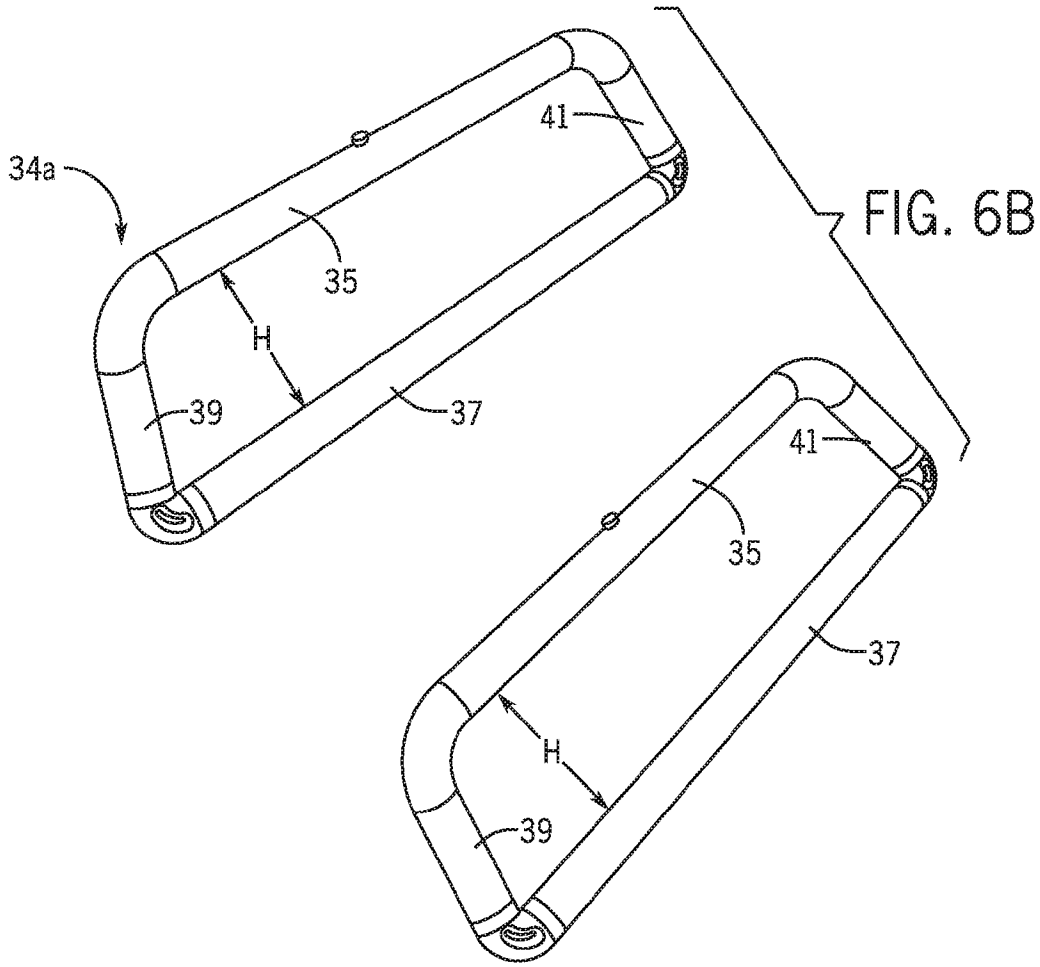
Figure 7A:
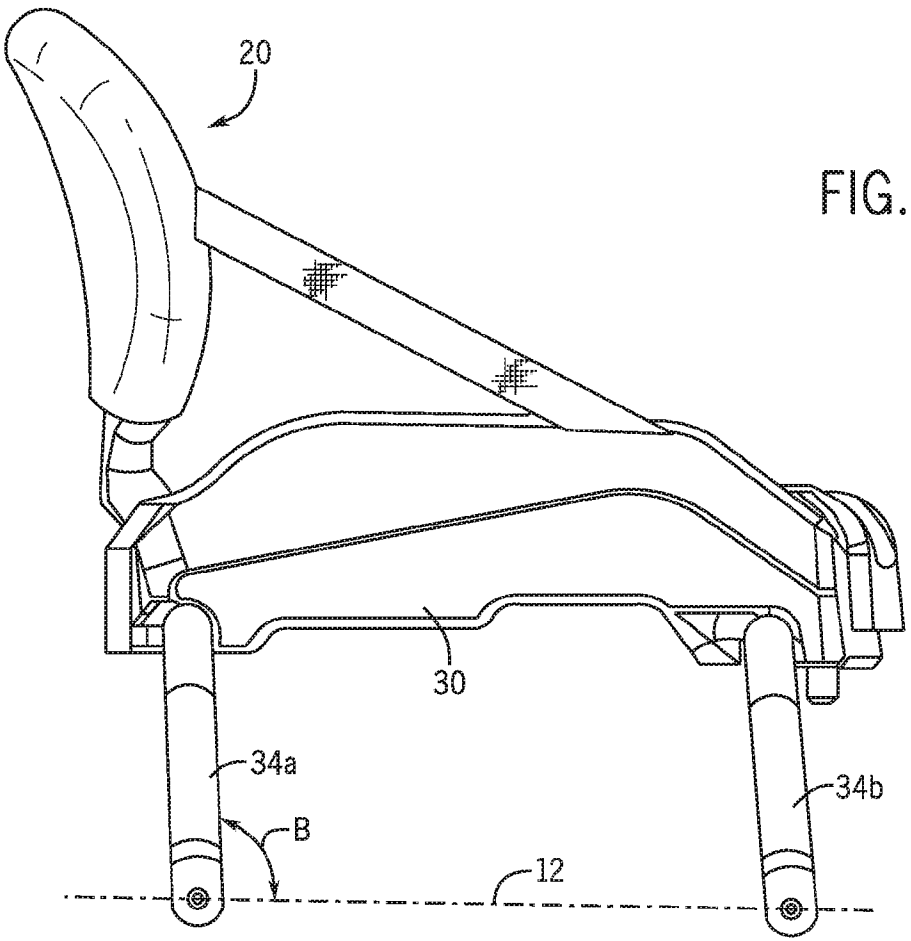
FIGS. 7A-7E illustrate the actuation of the example seat of FIG. 1 by movement of the example lift link of FIGS. 6A and 6B.
Figure 7B:
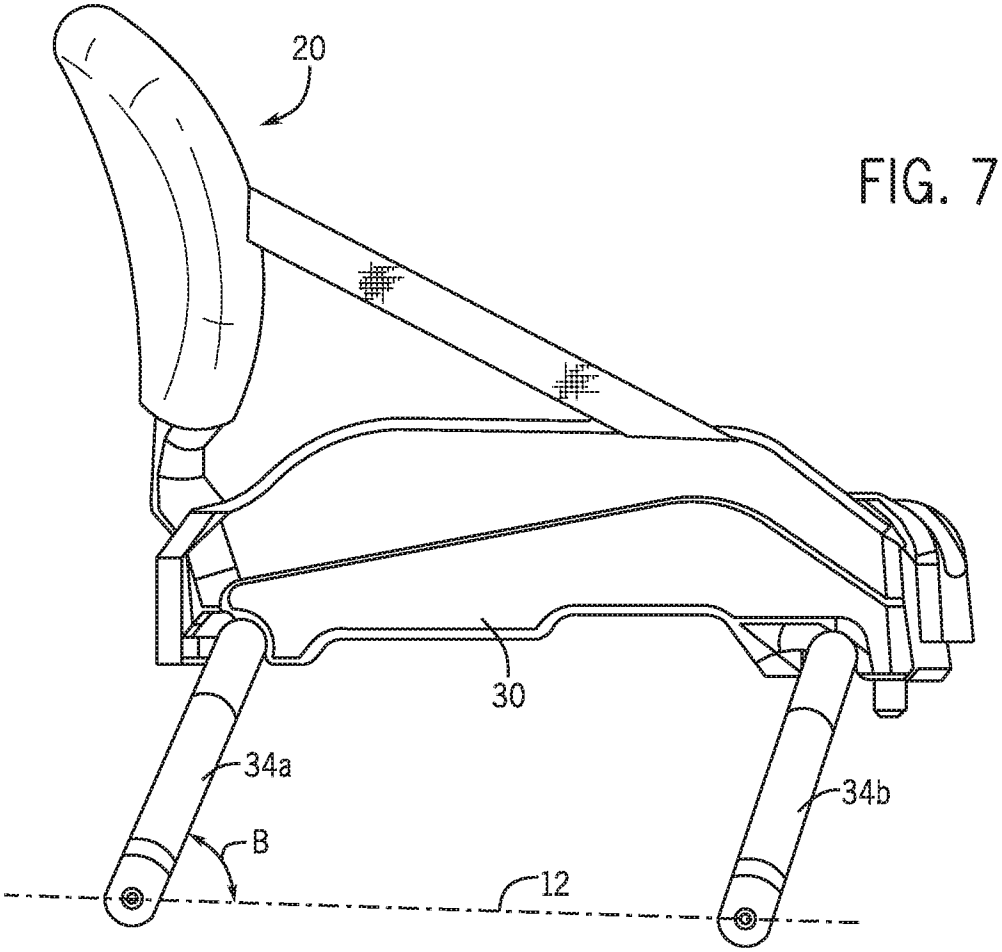
Figure 7C:
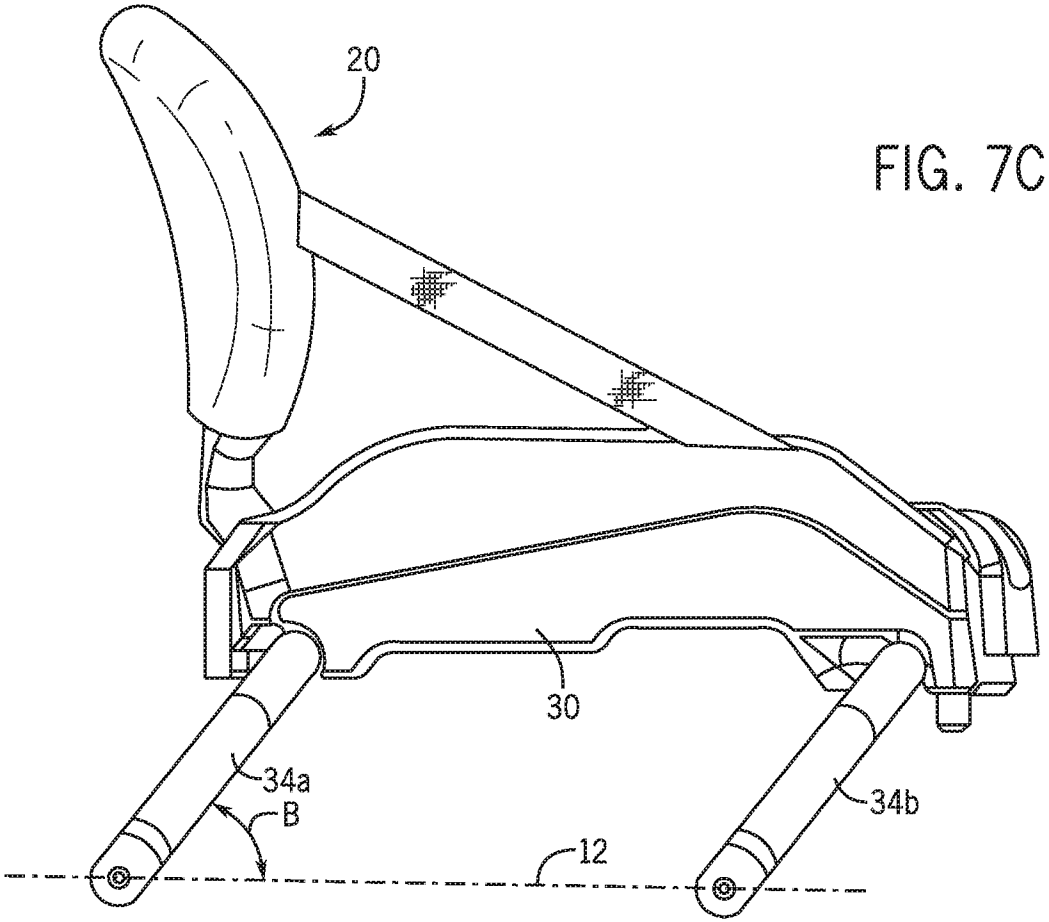
Figure 7D:
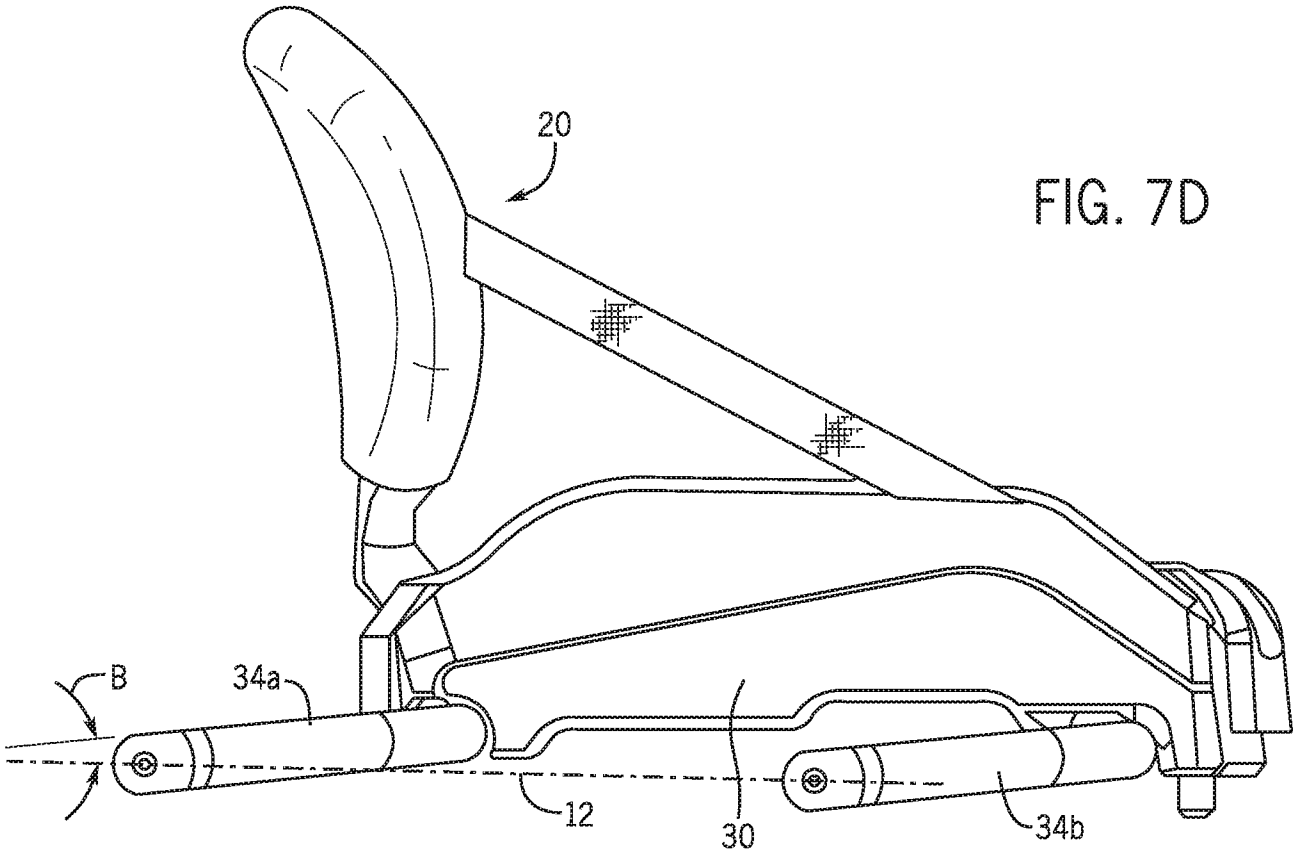
Figure 7E:
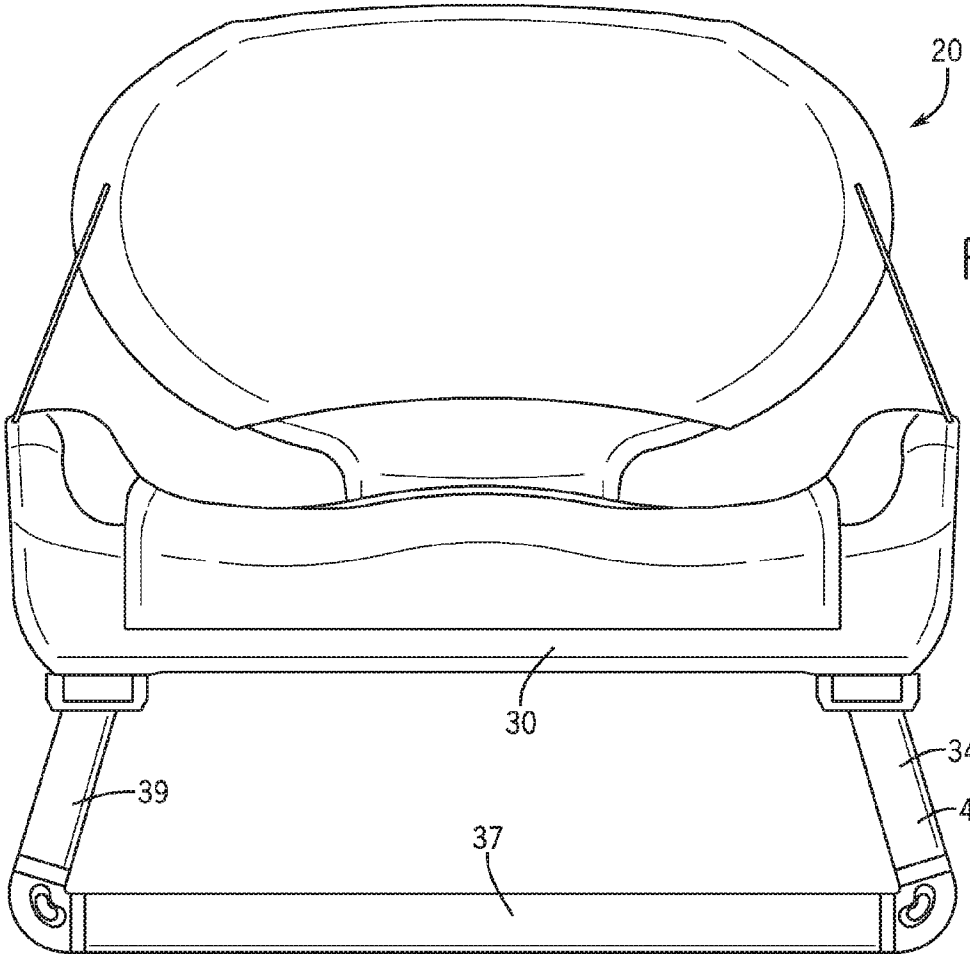

Still referring to FIG. 10, in this example, an underside 30 of the seat base 22 includes at least a pair of substantially parallel channels 32*a*, 32*b*, integrally formed within a rear portion 30*a* and a front portion 30*b* of the underside 30 of the seat base 22, respectively. The example channels 32*a*, and 32*b* are adapted and configured to pivotally receive a first rotatable lift link 34*a* and a second rotatable lift link 34*b*, respectively. As illustrated in FIGS. 6A and 6B, each example lift link is a tubular section shape comprising two parallel tubes 35, 37 used as rotation points (about an arrow B), connected by transverse tubes 39, 41, which in this example determine the amount of "lift" (e.g., a height H) the seat 20 achieves over the floor 12 of the hull 14 cockpit. In this example, the height H of each of the links 34*a*, 34*b* is the same.

Referring again to FIG. 10, the example floor 12 includes a plurality of attachment points 40 arranged and configured to pivotally receive the links 34*a*, 34*b*, and more particularly in this example, the bottom tube 37. in at least one instance, the attachment points 40 near the front portion 30*b* of the seat 20 releasable and pivotally receive the link 34*b*. It will be appreciated, however, that any combination of the attachment points (all, some, none) may be releasably coupled to the links 34*a*, 34*b*, or may alternatively be non-releasably coupled as desired.

Figure 13:
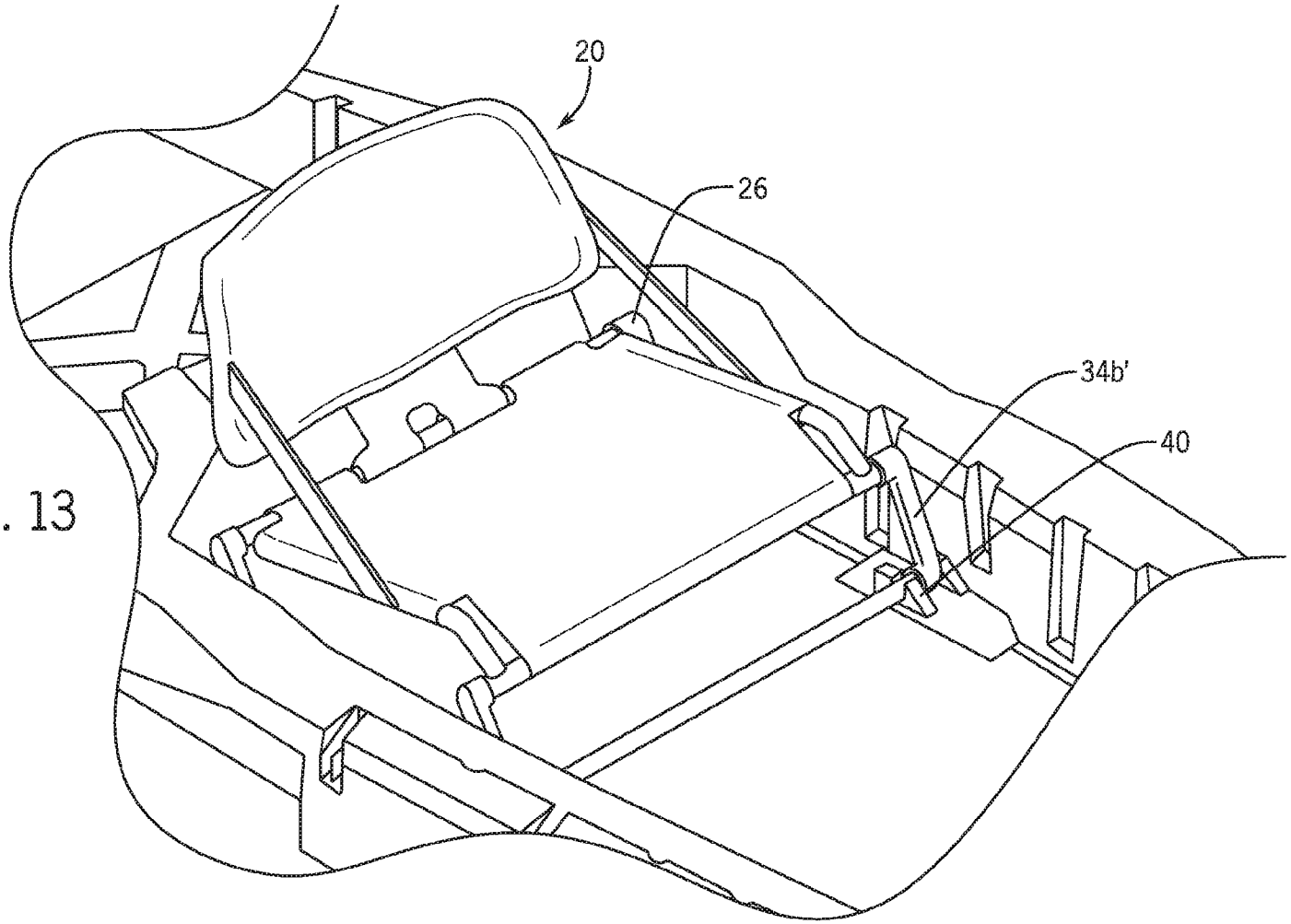
FIG. 13 is a front perspective view of an example adjustable kayak seat in accordance with the present disclosure, showing the example seat in the "seat up" position.

It will be further appreciated that the in combination, the links 34*a*, 34*b*, the seat base 20, and the floor 12 form a traditional four-bar pivoting mechanism. As such, it will be understood that each of the components may include additional attachment types and/or attachment locations, such as for example pivotal and slidable attachment points to allow for additional configurations of the four-bar link system as desired. Still further, as illustrated in FIG. 13, for example, each of the links 34*a*, 34*b* mat be any suitable configuration, and need not necessarily include a close tubular structure. For instance, a link 34*b'* may include the bottom tube 37 coupled to the attachment points 40 and coupled directly to the seat 20 via the pair of transverse tubes 39, 41. It will be understood that in yet other examples, the seat 20 may be directly coupled to the floor 12 only a. plurality of traverse connectors, such as pivot hinges (not shown).

Figure 8:
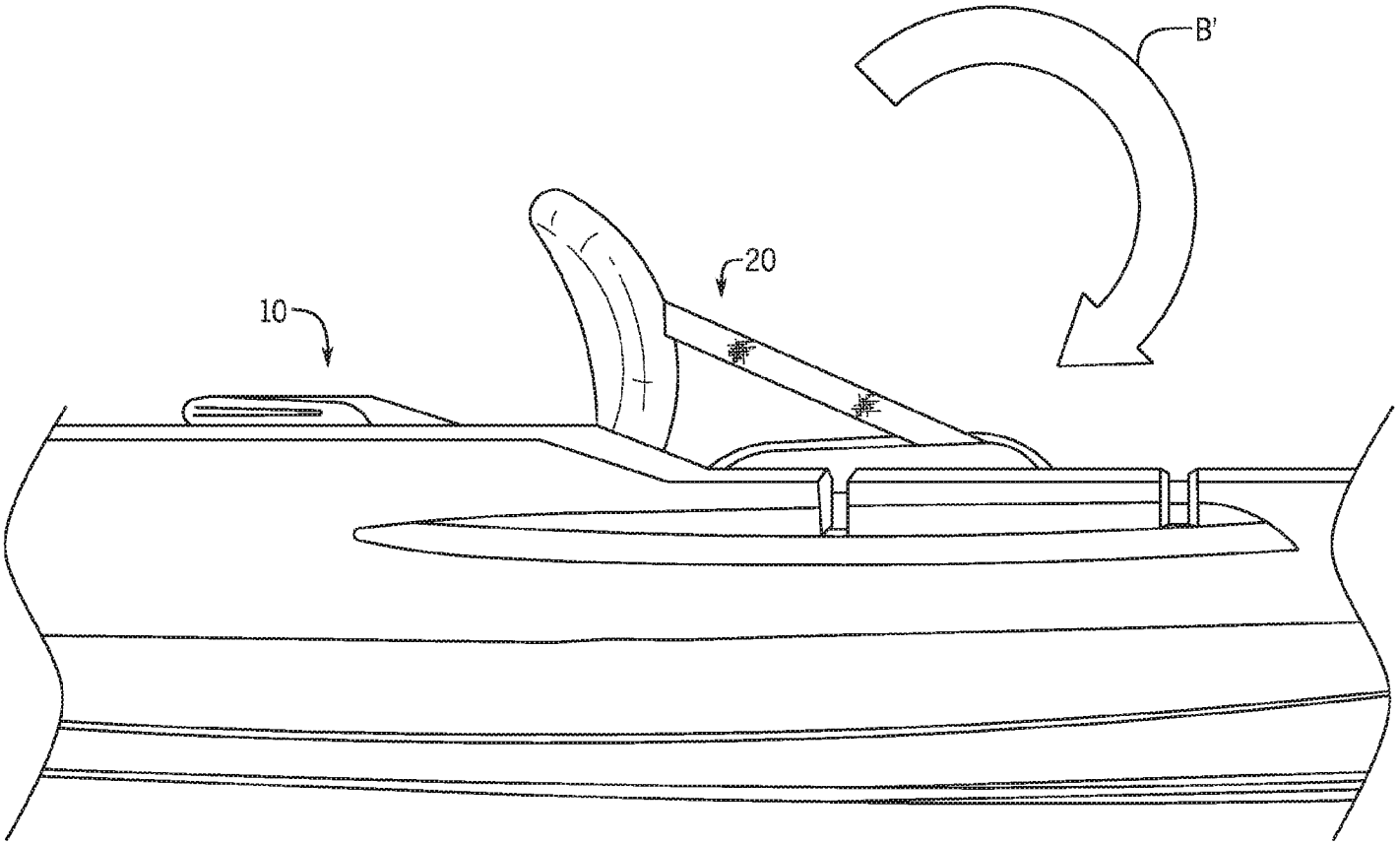
FIG. 8 illustrates one example movement of the example seat of FIG. 1 towards a "seat down" position.
Figure 9:
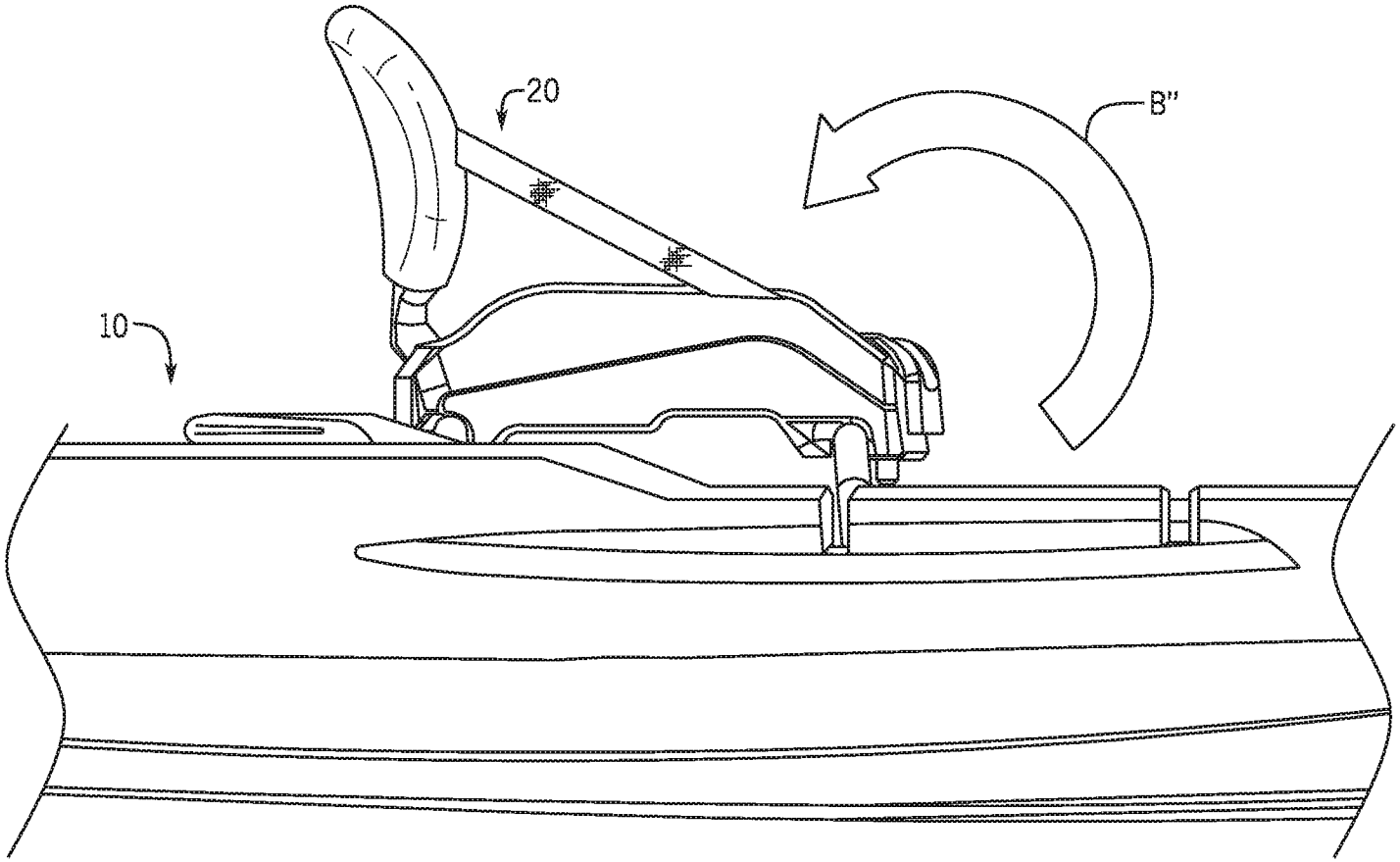
FIG. 9 illustrates another example movement of the example seat of FIG. I towards a "seat up" position.

As illustrated in FIGS. 7A-7E, in operation, the seat 20 may rotate between the "seat up" position (FIG. 7A) and the "seat down" position (FIG. 7D) by rotating the links 34A, 34*b* about their respective attachment points 40 in the direction of the arrow B. As illustrated in FIGS. 8 and 9, rotation of the links 34*a*, 34*b* causes the seat 20 to lift up and down about an arrow B' and B".

Figure 12:
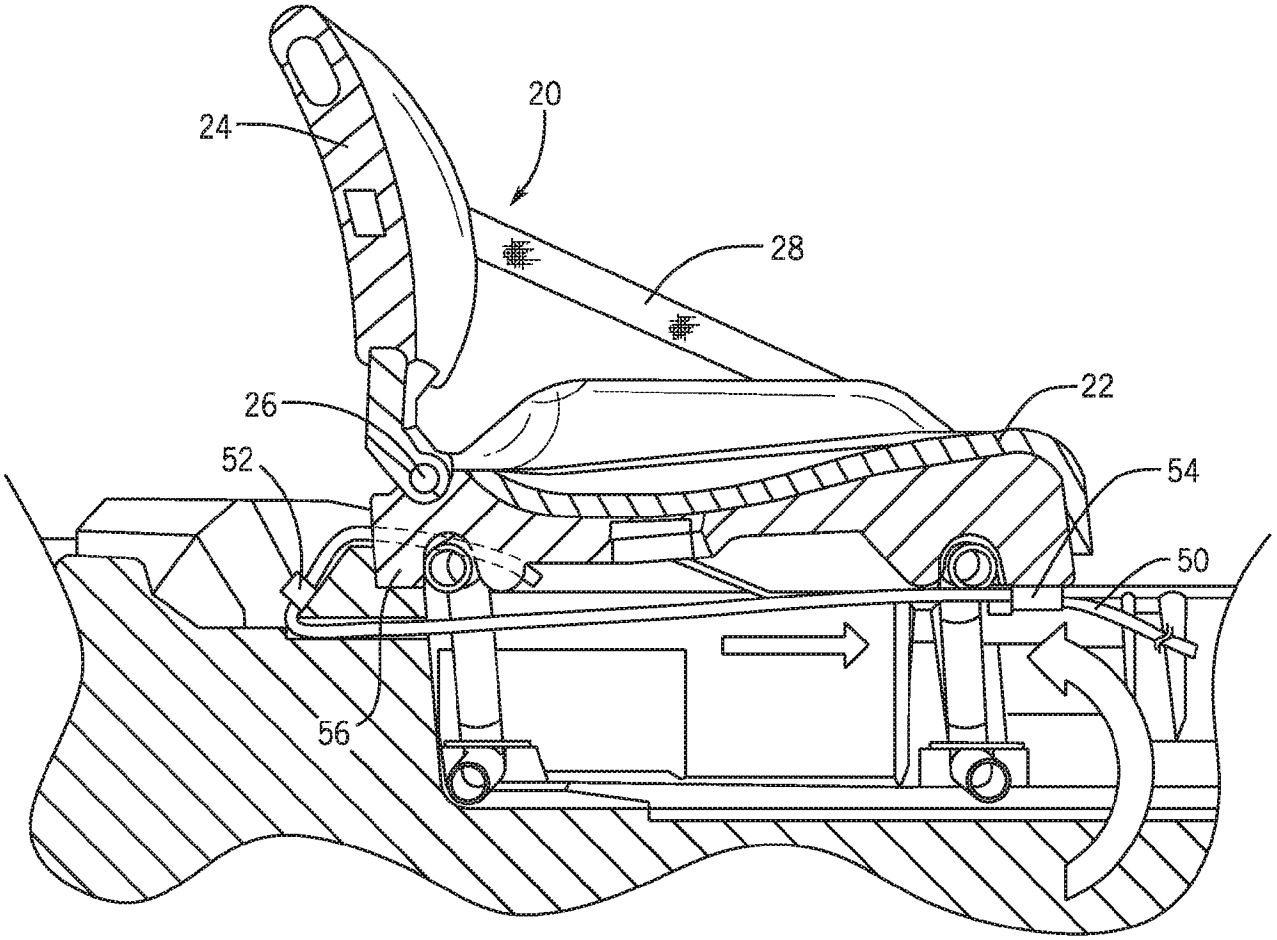
FIG. 12 cross section view illustrating one example method of actuating movement of the example seat of FIG. 1.

As shown in FIG. 12, the actuation of the movement of the seat 20 may be affected by any suitable means including grabbing of any portion of the seat, etc. In the illustrated example of FIG. 12, however, a pull strap 50 is moveably attached from the forward portion of the seat 20, around an anchor point 52 (e. ., a strap guide) and to the rearward portion of the seat 20. In this instance, the strap is fed through a forward strap buckle 54 and is attached to the seat base 22 as will be known to one of ordinary skill in the art. It will be appreciated that the actual path and/or attachment points of the pull strap 50 relative to the seat 20 may vary as desired.

In operation, the example pull strap 50 is used to raise the seat 20 on the links 34*a*, 34*b*. In particular, while optionally inhabiting or vacating the seat 20, the user may pull the pull strap 50 towards the front of the kayak 10 to affect a rearward force on the back of the seat 20, thereby actuating the seat about the lift links 34*a*, 34*b* and raising the seat 20 relative to the kayak 14. In this example, the strap buckle 54 may releasably hold the strap to maintain the seat 20 in the raised position. In order to release the seat 20 and allow the seat to rotate forward, the strap buckle 54 may be released, thereby allowing movement of the strap 50. As shown in FIG. 12, a support stop 56 may be integrally formed in the kayak 10 to allow provide additional support to the seat 20 when the seat is in the "seat up" position.

Figure 14:
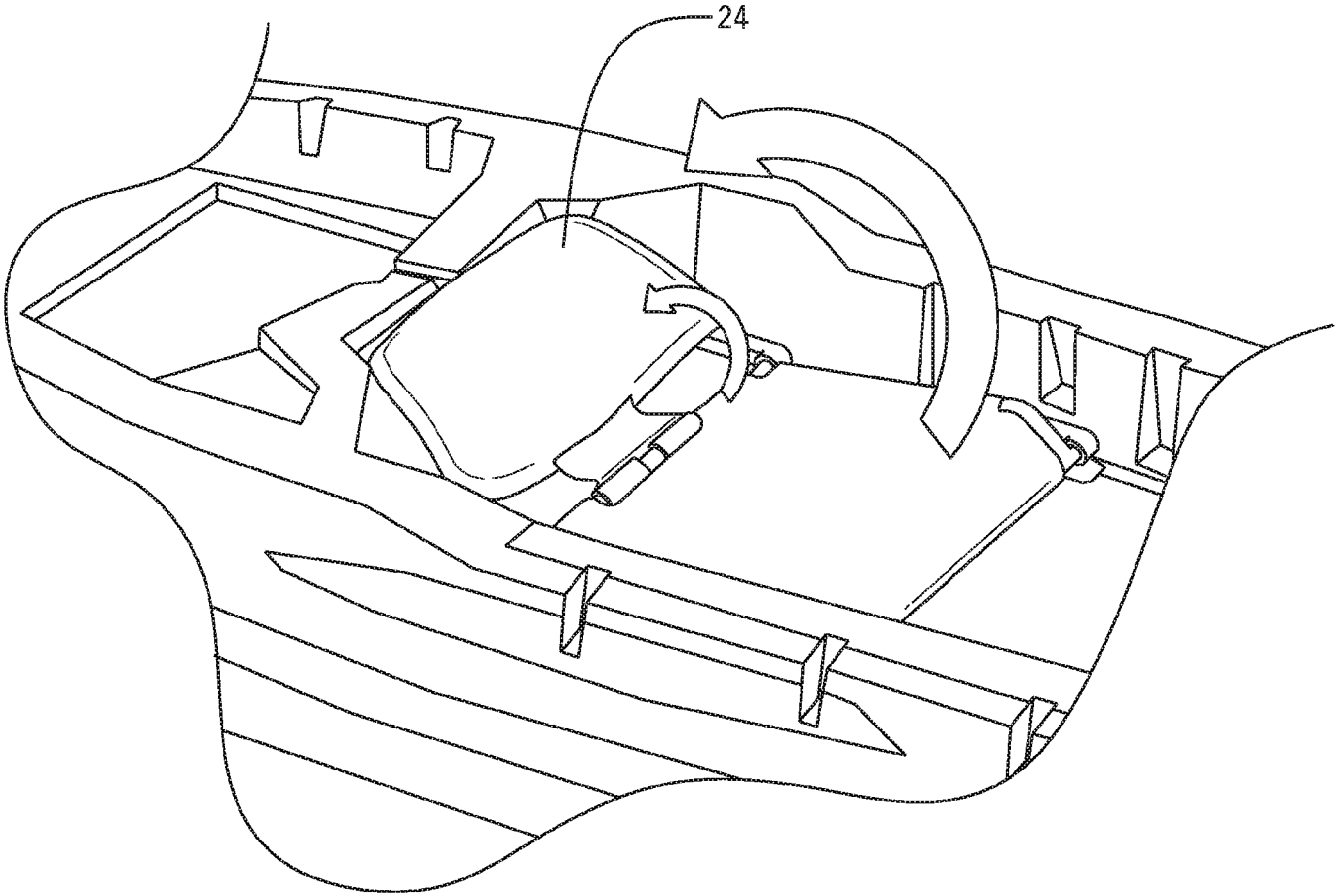
FIG. 14 is a front perspective view of the example seat of FIG. 13, showing the seat back in a reclined position.
Figure 15:
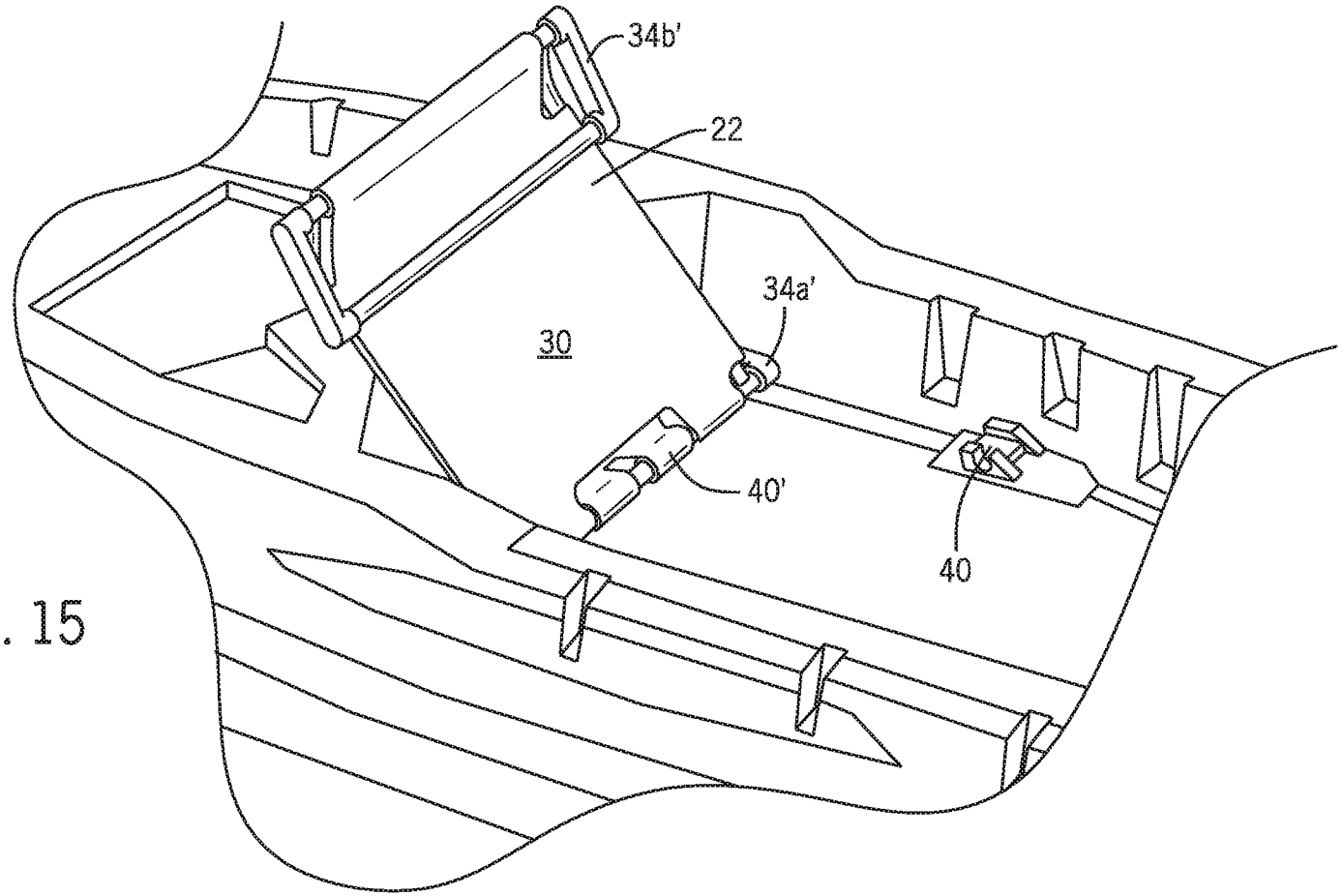
FIG. 15 is a front perspective view of the example seat of FIG. 13, showing the seat in a folded back position.

FIGS. 14 and 15 illustrate additional methods of operation of the seat 20. Specifically, as illustrated in FIG. 14, the seat back 24 may be pivotally moved in a forward (not shown) or a rearward direction as desired. It will be understood that operation of the lift seat between the "seat up" and the "seat down" position may be achieved while the seat back is in any suitable folded arrangement. Turning to FIG. 15, the seat 20 is shown is a folded back position, with the forward link 34*a'* released from the attachment point 40. In this instance, the seat 20 is pivoted about the attachment point 40'. It will be understood that in other examples, the seat 20 may be fully detachable from the kayak 10 to allow full removal of the seat 20 as desired, or the rear link 34*a* may be detachable to allow the seat 20 to be pivoted forward in the boat (such as for example is a two-seat kayak.

Although certain example methods and apparatus have been described herein, the scope of coverage of this patent is not limited thereto. On the contrary, this patent covers all methods, apparatus, and. articles of manufacture fairly falling within the scope of the present disclosure either literally or under the doctrine of equivalents.

I claim:

1. A watercraft seat comprising:

a seat base;

a first lift link having a first end pivotally coupled to a support surface of the watercraft and a second end pivotally coupled to a front portion of the seat base;

a second lift link distally located from the first lift link and having a first end pivotally coupled to a support surface of the watercraft and a second end pivotally coupled to a rear portion of the seat base; and a pull strap coupled to the seat base;

wherein operation of the pull strap assists in movement of the seat base between the first and second positions; wherein a first end of the pull strap is mounted to the front portion of the seat base, a second end of the pull strap is mounted to the rear portion of the seat base, and the pull strap is operably mounted through a strap guide coupled to the support surface and wherein the seat base is movable between at least a first position, wherein the seat base is positioned proximate to the support surface, and a second position, wherein at least one of the front portion or the rear portion of the seat base is positioned distal from the support surface.

2. The watercraft seat of claim 1, further comprising a seat back operably coupled to the seat base.

3. The watercraft seat of claim 2, wherein the seat back is pivotally coupled to the seat base.

4. The watercraft seat of claim 2, further comprising a tether operably coupled between the seat back and seat base to limit relative movement between the seat back and the seat base.

5. The watercraft seat of claim 1, wherein in combination, the seat base, the first lift link, the second lift link, and the support surface form a four-bar mechanism.

6. The watercraft seat of claim 1, wherein the first lift link comprises two parallel tubes operably coupled to a respective pivot mounted to the support surface and the seat base, and wherein the two parallel tubes are coupled at their respective ends by a support.

7. The watercraft seat of claim 1, wherein the second lift link comprises two parallel tubes operably coupled to a respective pivot mounted to the support surface and the seat base, and wherein the two parallel tubes are coupled at their respective ends by a support.

8. The watercraft seat of claim 1, wherein at least one of the first lift link or second lift link are releasably attachable to the seat base.

9. The watercraft seat of claim 1, wherein at least one of the first lift link or the second lift link are releasably attachable to the support surface.

10. The watercraft seat of claim 1, wherein at least one of the first lift link or the second lift link comprises a plurality of links extending between the support surface and the seat base.

* * * * *